US007311303B2

(12) United States Patent
Gonzalez et al.

(10) Patent No.: US 7,311,303 B2
(45) Date of Patent: Dec. 25, 2007

(54) APPARATUS AND METHOD FOR DISTRIBUTING PRINT MEDIA

(75) Inventors: Roberto Gonzalez Gonzalez, Jalisco (MX); Israel Cruz Ruiz, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 503 days.

(21) Appl. No.: 10/626,939

(22) Filed: Jul. 25, 2003

(65) Prior Publication Data

US 2005/0035522 A1 Feb. 17, 2005

(51) Int. Cl.
*B65H 39/10* (2006.01)

(52) U.S. Cl. ..... 271/296; 271/302; 414/790.3; 414/790.7

(58) Field of Classification Search ..... 271/296, 271/298, 300, 302; 414/789.9, 790.7, 790.9, 414/790.3; 270/38.08, 58.14, 58.08, 58.11, 270/58.17, 58.12
See application file for complete search history.

(56) References Cited

U.S. PATENT DOCUMENTS 3,315,957 A * 4/1967 Mazzio et al. ..... 271/296
3,356,362 A * 12/1967 Mestre ..... 271/289
3,848,868 A 11/1974 Stemmle
3,973,769 A 8/1976 Cross et al.
3,975,010 A 8/1976 Schisselbauer et al.
4,228,995 A 10/1980 Breuers et al.
4,235,431 A 11/1980 Abrams et al.
4,235,435 A 11/1980 Lawrence
4,285,508 A 8/1981 Kaneko
4,431,178 A * 2/1984 Kokubo et al. ..... 271/187
4,627,706 A 12/1986 Takahashi et al.
4,822,025 A * 4/1989 Chung ..... 271/296
4,830,357 A * 5/1989 Goto et al. ..... 271/293
4,830,358 A * 5/1989 Fazio et al. ..... 271/296
4,890,826 A * 1/1990 Rutishauser ..... 271/296
5,000,657 A * 3/1991 Gunther, Jr. ..... 414/790.3
5,044,623 A 9/1991 Munz et al.
5,050,860 A 9/1991 Matsuo et al.
5,061,098 A 10/1991 Engelhardt et al.
5,255,902 A 10/1993 Coombs
5,315,361 A * 5/1994 Sawada et al. ..... 399/403
5,382,012 A * 1/1995 Mandel et al. ..... 270/58.14
5,415,390 A 5/1995 Guerrero
5,484,255 A 1/1996 Lowell
5,722,031 A 2/1998 Fujii et al.
5,857,670 A 1/1999 Jung
5,915,686 A 6/1999 Neifert et al.
6,003,865 A 12/1999 Hayashi (Continued)

FOREIGN PATENT DOCUMENTS

EP 259828 A1 * 3/1988

(Continued)

OTHER PUBLICATIONS

Search Report for European Application No. EP04003205 (cited Nov. 26, 2004).

*Primary Examiner*—Joseph C. Rodriguez

(57) ABSTRACT

Various embodiments of an apparatus and method for distributing print media are provided. In one embodiment, the apparatus for distributing print media includes an accumulator that is pivotable about an axis. The accumulator has a print media inlet, a print media outlet, and an actuator that pivots the accumulator about the axis.

32 Claims, 2 Drawing Sheets

U.S. PATENT DOCUMENTS

| | | | | |
|---|---|---|---|---|
| 6,010,123 | A | 1/2000 | Stevens et al. | |
| 6,203,006 | B1 | 3/2001 | Semanick et al. | |
| 6,386,537 | B1 * | 5/2002 | Howard et al. | 271/303 |
| 2002/0067945 | A1 | 6/2002 | Kelley et al. | |

FOREIGN PATENT DOCUMENTS

| | | |
|---|---|---|
| WO | WO9941178 | 8/1999 |

* cited by examiner

APPARATUS AND METHOD FOR DISTRIBUTING PRINT MEDIA

BACKGROUND

In well-known print media handling systems, an apparatus for distributing print media can be integrated within, or modularly attached, to an image forming device such as, for example, a copier, printer, and facsimile, to name a few. Various design configurations of print media handling systems exist in order to provide flexibility for custom use.

In one conventional arrangement, an apparatus for distributing print media is positioned between an image forming device at one end and a plurality of stationary output bins at the opposite end. The apparatus for distributing print media can include an accumulator sized to house the print media, for example, 8½"×11" size paper, while the print media for a particular print job is accumulated prior to being ejected to an output bin. Once the print media is accumulated or undergoes a finishing operation, or both, the accumulator can move in linear fashion between several vertical positions which correspond to the adjacent output bins. The cost of such an arrangement can be relatively high and the overall surface area, or footprint, of such a system is typically large.

In another arrangement, the print media handling system can be an integrated function of the output bins. A plurality of movable output bins can be attached to the image forming device to receive and accumulate print media ejected from the image forming device. The plurality of output bins can move, typically vertically, to alternatively receive print media from a stationary outlet of the image forming device. If the image forming device is capable of serving several users networked on a system, and can produce facsimiles, printouts from a computer, and reproduced photocopies from an original, the user may not know the location of the job in the output bins and will most likely not know when the output bins will move. Thus, a disadvantage of such an arrangement is that the movement of the output bins may cause alarm or even injury to a user.

BRIEF DESCRIPTION OF THE SEVERAL VIEWS OF THE DRAWINGS

The example embodiments of the present invention can be understood with reference to the following drawings. The components in the drawings are not necessarily to scale. Also, in the drawings, like reference numerals designate corresponding parts throughout the several views.

DETAILED DESCRIPTION

Figure 1:
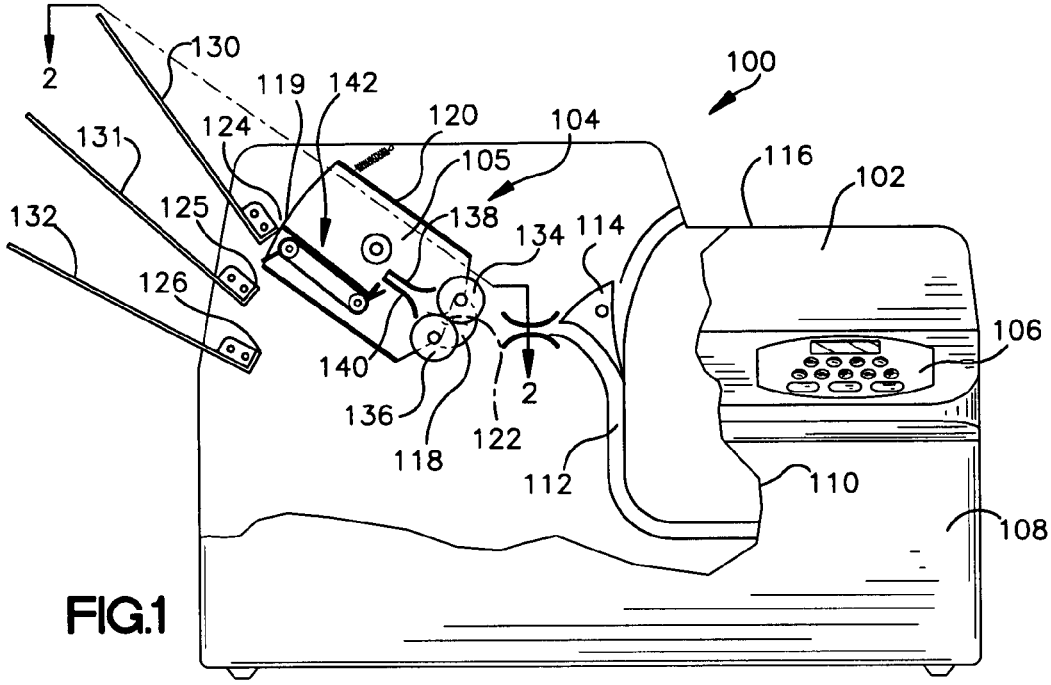
FIG. 1 is a schematic elevation view of an apparatus for distributing print media in a multifunctional system according to an embodiment of the invention.

For convenience, the apparatus for distributing print media of the present invention is described within the environment of a multi-functional printer (MFP), however, one skilled in the art can appreciate that the apparatus for distributing print media of the present invention could be used in other devices. A multi-functional printer, for example, can function as a printer for a facsimile, a printer for a personal or networked computer system, or as a printer for a copy machine. The MFP can be placed in office isle ways to be accessed by several users networked on a system, and both the multi-functional capabilities of the unit and the multiple user access can result in a greater number of jobs being performed. FIG. 1 illustrates a multi-functional printer 100 that includes an image forming device 102 and an apparatus for distributing print media 104. FIG. 1 shows apparatus for distributing print media 104 as an integrated component within multi-functional printer 100, however, the apparatus for distributing print media can be a separate and distinct apparatus from a printing apparatus, such as image forming device 102, for example.

The multi-functional printer 100 has an operator panel 106 along a front side 108 of external housing 110 for operating a variety of multi-functional printer functions. The front side 108 having an operator panel 106, for example, is a service side of the modular printing system 100 where much, if not all, of the user interface and control over the multi-functional printer 100 takes place. The operator panel 106 may include, for example, push buttons and other input and display devices that can be used for configuration of the operation of the multi-functional printer 100. For example, the operator panel 106 may facilitate specification of the size of print media, the type of finishing operation, and other operational parameters, etc.

The apparatus for distributing print media 104 can function to receive print media and distribute print media to at least two radial locations. The cut out of external housing 110 reveals the paper path 112 through which print media is transported from image forming device 102. Depending on the positioning of diverter 114, the print media can be diverted toward the apparatus for distributing print media 104 or toward output tray 116 of the image forming device 102.

Still referring to FIG. 1, the apparatus for distributing print medial 104 includes an accumulator 105 that is pivotable about axis 122. The accumulator 105 has a print media inlet 118 and a print media outlet 119 to receive and discharge print media, respectively. The apparatus for distributing print media 104 also includes an actuator 201 (FIG. 2) operatively connected to the accumulator 105 to pivot the accumulator 105 about axis 122 to alternatively associate the print media outlet 119 with at least two radial locations. As shown in FIG. 1, print media outlet 119 of accumulator 105 is associated with radial location 124, however, the print media outlet 119 can also be associated with radial locations 125 and 126, as well as a number of radial locations not shown. The accumulator 105 can be associated with many different radial locations.

When diverter 114 allows routing of the print media to accumulator 105 as shown, print media is moved through the accumulator 105 by top input roller 134 and bottom input roller 136 as it enters accumulator housing 120. Upper plate 138 and a lower plate 140 guide each page of the print media toward staging location 142. Print media handling apparatus other than top input roller 134, bottom input roller 136, upper plate 138 and lower plate 140, may be employed to move and guide the print media to staging location 142. The print media outlet 119 is shown positioned at a first radial location 124 where staging location 142 is aligned with output bin 130. The print media which is transported to staging location 142 while accumulator 105 is positioned at radial location 124 can be discharged to output bin 130, and accumulator 105 can then be rotated about axis 122 to other radial locations 125, 126, for example, such that print media outlet 119 is aligned with output bins 131, 132. The accumulator 105 is therefore in position to receive additional print media which can be transported to staging location 142 and discharged through print media outlet 119 to output bin 131 or 132. Thus, the accumulator 105 is able to pivot about axis 122 to at least two radial locations to discharge print media to at least two output bins, although there may be more radial locations and corresponding output bins to the extent practicable.

The accumulator 105 can receive a single sheet of print media and can then discharge the sheet of print media to an output bin, for example, one of output bins 130, 131, and 132, before receiving additional pages of print media. Alternatively, the accumulator 105 can receive two or more sheets of print media and accumulate the sheets into a stack before discharging the stack to an output bin 130, 131, 132.

Staging location 142 is configured to support at least a portion of print media of a predefined dimension. The print media can be predefined to be any size, for example, 17 inches by 14 inches, 8½ inches by 11 inches, (i.e. legal, letter, A4, etc.), as is known by one of ordinary skill in the art. For example, staging location 142 may be sized to match or exceed the full size of print media received by the accumulator. Still in other embodiments of the present invention, the staging location 142 can have a surface area sized to accommodate only a portion of the print media rather than the full surface area of the predefined print media that is handled by the apparatus for distributing print media 104. For example, the staging location can be less than 17 inches by 14 inches, and can be less than 8½inches by 11 inches, and so on, and is smaller than the predefined print media. In such an arrangement, the staging location 142 of the accumulator 105 can accommodate a portion of the print media such that a remaining portion of the print media that is not supported by the staging location 142 is external to the accumulator 105.

Therefore, the staging location 142 may be smaller than the staging location of an accumulator sized to support the entire surface area of the print media, thereby contributing to a more compact size of the accumulator 105.

Figure 2:
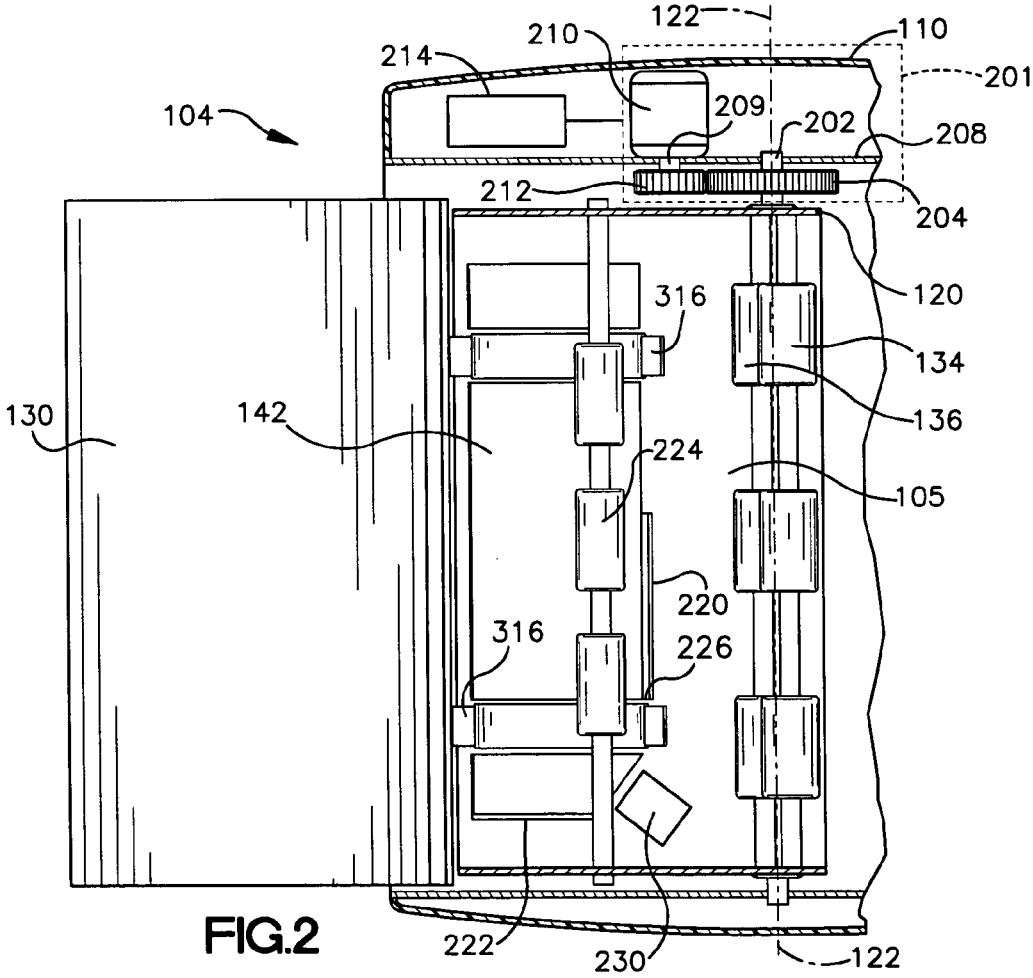
FIG. 2 is a schematic cross-sectional top view of an apparatus for dispensing print media taken along lines 2-2 of FIG. 1 according to an embodiment of the invention.

Turning to FIG. 2, shown is a top cross-sectional view of the apparatus for distributing print media 104, taken along line 2-2 of FIG. 1. In one embodiment of the present invention the rotation of accumulator 105 about axis 122 is accomplished by virtue of an actuator 201 that includes a gear assembly having a pin 202 and a gear 204. Gear 204 is in physical communication with pin 202 and rotation of the gear 204 causes rotation of the pin 202. Pin 202 is shown extending through the accumulator housing 120 and supported by an internal housing 208 of the multi-functional printer 100 (FIG. 1). Rotation of pin 202, which is in physical communication with accumulator 105, causes the rotation of the accumulator 105.

The actuator 201 further includes a motor 210 and gear 212 that engages the gear 204. The motor 210 can be, for example, a DC motor, an AC motor, a stepper motor, or other suitable mechanism. The operation of the motor 210 may be controlled by a control system that includes controller 214, the details of which will be further described below. Therefore, as shown in FIG. 2, the motor 210 includes driveshaft 209 to which a gear 212 is attached. Gear 212 is engaged with the gear 204. When the motor 210 is caused to move by the application of an appropriate electrical signal thereto, the gear 212 rotates gear 204 and causes rotation of both the pin 202 and the accumulator 105. The pin 202 which is in physical communication with accumulator 105 causes the accumulator to rotate about axis 122. In an alternative embodiment, the drive shaft 209 is directly connected to the accumulator housing 120 to and rotates the accumulator 105 without the need for a gear assembly, for example, gears 212 and 204.

While the actuator 201 for rotating accumulator 105 about axis 122 is described as including the pin and gear apparatus described above, the actuator 201 may employ other approaches. For example, the actuator 201 may be a cam and follower apparatus, a pulley and string apparatus, a rack and pinion apparatus, an "n-bar" linkage assembly, such as a two-bar and a four-bar linkage assembly, for example, that converts linear movement to rotational movement, a solenoid and pivot lever apparatus, and other lever apparatus arrangements for example, as well as other mechanical, electrical and electro-mechanical apparatuses that facilitate the rotation of accumulator 105 about the axis 122 as can be appreciated by one of ordinary skill in the art.

Still referring to FIG. 2, as the print media enters the accumulator 105 the print media can be moved by upper rollers 134 and lower rollers 136 to staging location 142. The lower plate 140 (FIG. 1) can be positioned above staging location 142 so that the print media can drop into place by gravity onto the staging location 142. The apparatus for distributing print media 104 can also include registration walls 220 and 222, and registration rollers 224 to align the edges of a single page or multiple pages of the print media. Registration walls 220 and 222 are shown orthogonal to each other and extending upward from staging location 142. Registration roller 224 exerts a force on a single sheet print media as it drops onto the staging location, or exerts a force on the topmost sheet of a stack of print media after it drops onto a stack of print media from the lower plate 140. The force of the roller can be in a direction toward a point of intersection of the registration walls 220 and 222 to square off a corner of print media. At least one of the registration walls 220 and 222 can also include a tab (not shown) which extends outward from at least one of the registration walls 220 and 222 and over the staging location 142 to prevent the print media from curling or riding upward onto the registration walls.

The dispensing apparatus can also include a finishing device 230. The finishing device 230 can be any device that operates on the print media, including but is not limited to, a stapler, a punching device and a glue applicator, for example, or another finishing device as can be appreciated by those of ordinary skill in the art. For example, assuming the finishing device 230 in FIG. 2 is a stapler, the stapler can move vertically downward toward a stack of print media to inject a staple into the print media once the print media has been accumulated and registered at the staging location 142.

Figure 3:
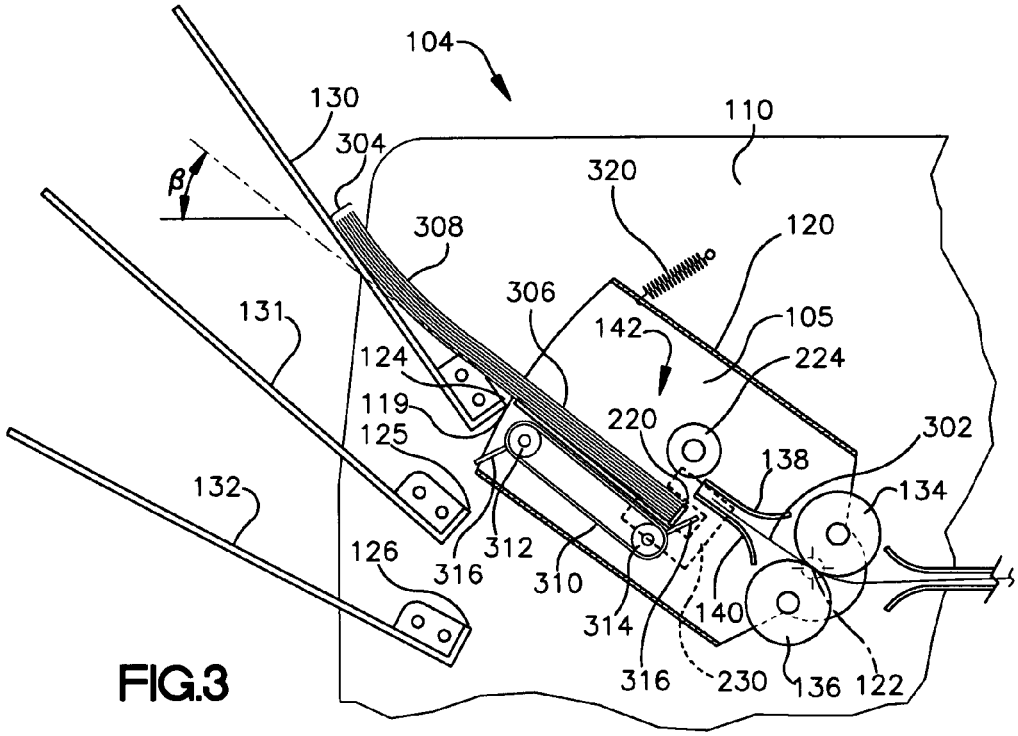
FIG. 3 is a schematic cross-sectional elevation view of an apparatus for dispensing print media of FIG. 1 showing the accumulator associated with a first radial location according to an embodiment of the invention.
Figure 4:
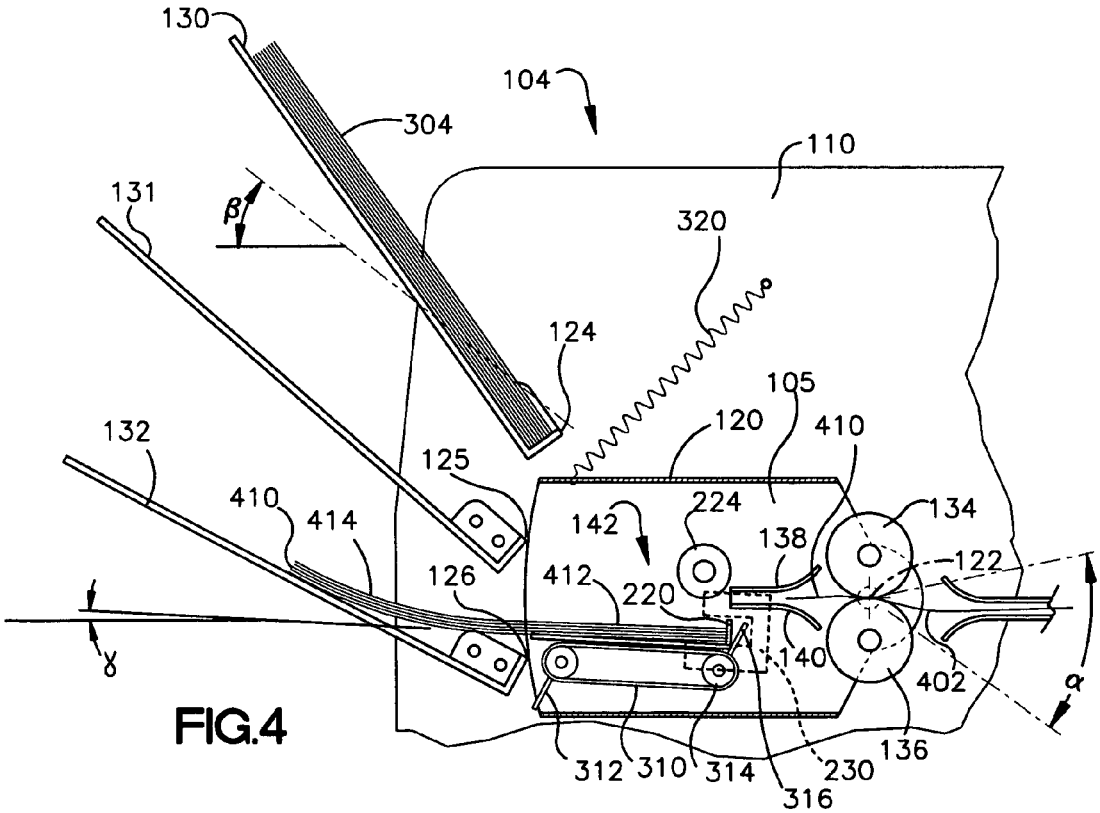
FIG. 4 is a schematic cross-sectional view of an apparatus for dispensing print media of FIG. 1 showing the accumulator associated with a second radial location according to an embodiment of the invention.

Referring next to FIGS. 3 and 4, a description of the operation of the apparatus for distributing print media 104 is provided. A single page 302 of print media is shown entering accumulator 105 between upper roller 134 and lower roller 136 and is guided between upper plate 138 and lower plate 140 toward staging location 142. A stack of print media 304 is shown supported by staging location 142. A first portion 306 of the topmost page of the stack of print media 304, like the other pages of the stack, is shown supported by the staging location 142 and a second portion 308 of the topmost page of the stack of print media 304 is supported by output bin 130. Thus, a portion of the print media is located inside the accumulator 105 and the remaining portion of print media is external to the accumulator 105. The staging location 142 and accumulator 105 can thus be sized to support less than the entire surface area of the print media and so the overall surface area, or footprint, of the apparatus for distributing print media 104 can be correspondingly reduced. Since a portion of the print media is supported by the staging location 142, a finishing operation, for example stapling, may be performed within the accumulator by finishing device 230. Alternatively, the staging location 142 may be as large as the print media as was discussed above.

Once the finishing operation is completed, the stack of print media 304 can be discharged from the accumulator 105 and fully placed on output bin 130. Still referring to FIG. 3, beneath the staging location 142 is a belt 310 that rotates when the print media is to be moved off of the staging location 142 and out of accumulator 105. The belt 310 can be moved by rollers 312 and 314, and the belt has at least one finger or protrusion 316 that moves through a slot (not shown) of the registration wall 220 so that the protrusion 316 comes into contact with the edge of the print media adjacent to the registration wall 220. After protrusion 316 comes into contact with the stack of print media 304, the protrusion 316 moves through a slot (not shown) of the staging location to discharge the print media from the accumulator 105 as belt 310 rotates. Alternatively, any discharging apparatus that can move the print media out of the accumulator 105 can be used. Optionally, lateral guides (not shown) can be connected to the accumulator 105 to guide the edges of print media being transported by the belt 310. Therefore, in this arrangement, moving parts of the apparatus for distributing print media 104 are advantageously located inside the accumulator housing 120 and print media may be discharged to stationary output bins 130, 131, and 132, without the need for external moving parts. After print media is discharged from the accumulator 105, the accumulator 105 can be moved to a different radial location or can remain in the same radial location to receive additional print media. In any event, the output bins 130, 131, 132 remain stationary at all times.

With specific reference to FIG. 4, the stack of print media 304 is shown supported by output bin 130 and accumulator 105 has been rotated about axis 122 to radial location 126 to receive additional print media of another print job. A sheet of print media 402 is shown entering accumulator 105 between upper plate 138 and lower plate 140 and will drop in staging location 142 onto stack of print media 410. A first portion 412 of the topmost paper of the stack of print media 410 is supported by accumulator 105 and a second portion 414 of the topmost paper of the stack of print media 410 is supported by output bin 132. The pages of the print media can be stacked and registered one by one until the last page is received in the staging location 142. The stack of print media 410 may then undergo a finishing operation before it is discharged from the accumulator 105.

While still referring to FIG. 4, the rotation of the accumulator 105 of the apparatus for distributing print media 104 is denoted by the operating angle of rotation, alpha. The operating angle of rotation $\alpha$ may be, for example, about 90 degrees or less, however, the angle of rotation $\alpha$ can be greater or less than about 90 degrees where practicable. The operating angle of rotation $\alpha$ can be set taking into account the force of gravity on the print media, among other factors. For example, the angle $\beta$, which is the angle between the horizontal plane and the staging location 142 when the accumulator 105 is discharging print media to uppermost output bin 130, may be specified so as to allow retention of the stack of print media 304 in the output bin 130.

The operating angle of rotation $\alpha$ can also depend on, the angle $\gamma$, which is the angle between the horizontal plane and the staging location 142 when the accumulator 105 is discharging the print media to the lowermost output bin 132. The angle $\gamma$ may be specified to ensure that the stack of print media 410 will not be pulled away from the staging location 142 and registration wall 220 by the action of gravity. The angle $\gamma$ as shown in FIG. 4 is the angle between the horizontal plane and the staging location 142 above the horizontal plane, however, the staging location 142 could also be positioned below the horizontal axis, where practicable. The number of output bins, for example, output bins 130, 131, 132, can depend upon the size operating angle of rotation $\alpha$ necessary to physically align with the output bins 130, 131, 132 and the space allotted between output bins 130, 131, and 132, among other factors. The spacing between output bins 130, 131, 132, for example, is also a factor in determining the amount of print media that can be accumulated on staging location 142 and the output bins. There can therefore be a tradeoff between the number of output bins and the spacing between the output bins, given a predetermined operating angle of rotation $\alpha$.

The apparatus for distributing print media 104 can further include an apparatus for counterbalancing the force of gravity on the accumulator 105 and print media which accumulates on the staging location 142. An apparatus for counterbalancing can include, for example, tension spring 320 shown in FIG. 3 and FIG. 4 which can be attached to accumulator housing 120 on one end and attached to external housing 110 of the multi-functional printer on another end, for example. It is possible for the apparatus for distributing print media 104 to operate without an apparatus for counterbalancing, however, it can relieve the torque on the actuator 201, for example, the pin 202 and gear 204 described above with respect to FIG. 2.

In another embodiment of the present invention the apparatus for distributing print media 104 further includes a controller 214 (FIG. 2) operatively coupled to the actuator 201 (FIG. 2). The controller 214 sends and receives signals that can dictate the rotation of accumulator 105 to the different radial positions, including but not limited to radial positions, 124, 125, and 126. For example, when a signal from the controller 214 is received indicating that print media for a new print job is coming, the actuator 201 moves the accumulator 105 to a different radial position from its current position, to align the staging location 142 with an output bin 130, 131, and 132. The controller 214 can also be operatively coupled to at least one of the input rollers 134, 136, the finishing device 230 and belt 310 to coordinate movement of the print media. For example, when a signal from the controller 214 is received indicating that the last page of print media for a print job is entering the accumulator 105, the controller 214 can signal the finishing device 230 to perform a finishing operation, and the controller 214 can also signal the belt 310 to move the print media out of the accumulator 105 after finishing has occurred. The controller 214 can then signal the actuator 201 to rotate the accumulator 105 to a different radial location or to remain at the same radial location.

In one embodiment of the present invention as described above with reference to FIG. 2, the actuator 201 can be a gear and pin arrangement, for example, gear 204, gear 212 and pin 202 driven by motor 210 and driveshaft 209. The motor 210 can be a stepper motor, a DC motor, or an AC motor, for example, each of which can be driven by a controller 214. A stepper motor can have a separate control system that controls the actions of the motor based on a predetermined number of pulses by the motor. The operation of a DC or AC motor, for example, may be controlled to dictate positioning of the accumulator 105 by the operation of a micro-switch or limit switch or other types of sensors. For example, limit switches or micro-switches can be positioned at the radial locations where the accumulator 105 lines up with each output bin, 130, 131, 132, for example, thereby signaling the controller 214 upon contact to turn off the motor. As another example, phototransistors can be positioned at each output bin 130, 131, 132, for example, to track a light emitting diode positioned to move with the accumulator 105. For example, in an initial state, a micro-switch can be open and no power is applied to motor 210. A signal from controller 214 device can causes the micro-switch to close thereby applying power to motor 210 to cause the accumulator 105 to rotate. This action can cause the micro-switch to open again and to remove power from the motor 210. The process repeats itself, as required, when a new print job is detected from the controller 214.

FIG. 1 shows an example of one of the many ways in which the apparatus for distributing print media 104 can be used, where several arrangements are possible. The apparatus for distributing print media 104 is positioned between an image forming apparatus 102 and a plurality of output bins 130, 131, 132. In another embodiment of the present invention, the apparatus for distributing print media further includes at least two output bins, for example, output bins 130, 131, 132, which are stationary relative to an axis 122. By stationary it is meant that the output bins do not move relative to axis 122 about which the accumulator 105 rotates. For example, in one embodiment, the output bins 130, 131, 132, can be attached to a housing, for example, internal housing 208 of FIG. 2, that supports a pin 202 (FIG. 2) along the axis 122 as a single unit and attached to an image forming device 102 (FIG. 1) inside a common housing 110 (FIG. 1) or as a separate modular device (not shown).

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

What is claimed is:

1. An apparatus for distributing print media comprising:

an accumulator pivotable about an axis, the accumulator having a print media inlet and a print media outlet;

the accumulator being configured to accumulate a plurality of sheets of a print media;

a belt having a protrusion that transports the print media out of accumulator through the print media outlet;

an actuator configured to pivot the accumulator about the axis;

a plurality of output bins, each of the output bins being positioned with an entry point along an arc traced by the print media outlet of the accumulator; and the accumulator comprises a media staging area configured to support the accumulation of the sheets of the print media, the staging area comprising a combination of a staging location in the accumulator and a portion of a respective one of the output bins, where the accumulator pivots to align the staging location with one of the output bins.

2. The apparatus of claim 1, wherein the actuator further comprises a motor.

3. The apparatus of claim 2 wherein the actuator comprises a gear assembly for transferring rotational movement from the motor to the accumulator.

4. The apparatus of claim 1 wherein the surface area of the staging location is less than the size of the print media.

5. The apparatus of claim 1 further comprising at least one input roller that transports the print media to staging location in the accumulator.

6. The apparatus of claim 1 further comprising a controller operatively coupled to the actuator.

7. The apparatus of claim 1 further comprising:

a controller operatively coupled to at least one of the actuator, the input rollers and the belt to coordinate the movement of print media through the accumulator.

8. The apparatus of claim 1 further comprising:

a registration roller that moves the print media against a registration wall to align an edge of the print media; and a finishing device disposed inside the accumulator to perform a finishing operation on the print media.

9. The apparatus of claim 1, wherein each of the output bins are stationary relative to the axis.

10. The apparatus of claim 9 wherein each of the output bins is positioned at a respective location along the arc to receive print media from the print media outlet of the accumulator.

11. An apparatus for distributing print media comprising:

an accumulator having a print media inlet and a print media outlet, the accumulator pivoting about an axis of rotation;

the accumulator being configured to accumulate a plurality of sheets of a print media;

a belt having a protrusion that transports the print media out of accumulator through the print media outlet; and means for rotating the accumulator about the axis;

a plurality of output bins, each of the output bins being positioned with an entry point along an arc traced by the print media outlet of the accumulator; and a media staging area configured to support the accumulation of the sheets of the print media by the accumulator, the staging area comprising a combination of a staging location in the accumulator and a portion of a respective one of the output bins, where the accumulator pivots to align the staging location with one of the output bins.

12. The apparatus of claim 11 wherein the staging location has a surface area that is less than the surface area of a predetermined size of the print media that is received by the accumulator.

13. The apparatus of claim 11 further comprising means for transporting the print media through the accumulator.

14. The apparatus of claim 11 further comprising means for transporting the print media out of the outlet of the accumulator.

15. The apparatus of claim 11 further comprising means for activating the means for rotating the accumulator about the axis.

16. The apparatus of claim 15 wherein the means for activating the means for rotating the accumulator is also a means for activating the means for transporting the print media through the accumulator and a means for activating the means for transporting the print media out of the outlet of the accumulator.

17. The apparatus of claim 11 further comprising:

means for aligning the print media inside the accumulator; and finishing means for performing a finishing operation on the print media.

18. The apparatus of claim 11 wherein the output bins are stationary relative to the axis.

19. The apparatus of claim 18 wherein each of the output bins is positioned at a respective location along the arc to receive print media from the print media outlet of the accumulator.

20. A method for distributing print media comprising:

aligning an accumulator with a first location;

receiving a plurality of sheets of a print media sequentially through an inlet of the accumulator;

accumulating the plurality of sheets of the print media in the accumulator before dispensing the print media through an outlet of the accumulator;

positioning the print media received at the inlet such that a portion of the print media is supported by a staging location in the accumulator and a portion of the print media is supported by an output bin;

dispensing the print media through the outlet of the accumulator at the first location;

rotating the accumulator about an axis of rotation to align the accumulator with a second location.

21. The method of claim 20 further comprising, supporting a portion of the print media on a staging location in the accumulator.

22. The method of claim 20 further comprising, transporting the sheets of the print media from the inlet of the accumulator to the staging location in the accumulator prior to dispensing the sheets of the print media.

23. The method of claim 22 further comprising, registering the sheets of the print media after the sheets of the print media is transported to the staging location.

24. The method of claim 23 further comprising, finishing the registered sheets of the print media in the staging location with a finishing device.

25. A printing apparatus comprising:

an image-forming device;

an accumulator pivotable about an axis, and configured to receive print media from the image-forming device;

the accumulator being configured to accumulate a plurality of sheets of print media;

a belt having a protrusion that transports the print media out of accumulator through the print media outlet;

an actuator configured to pivot the accumulator about the axis;

a plurality of output bins, each of the output bins being positioned with an entry point along an arc traced by a print media outlet of the accumulator; and a media staging area configured to support the accumulation of the sheets of the print media by the accumulator, the staging area comprising a combination of a staging location in the accumulator and a portion of a respective one of the output bins, where the accumulator pivots to align the staging location with one of the output bins.

26. The printing apparatus of claim 25, wherein the surface area of the staging location is less than the surface area of the print media.

27. The printing apparatus of claim 25, wherein the actuator further comprises a motor.

28. The printing apparatus of claim 27, wherein the actuator comprises a gear assembly for transferring rotational movement from the motor to the accumulator.

29. The printing apparatus of claim 25, further comprising a controller operatively coupled to the actuator.

30. The printing apparatus of claim 25, wherein each of the output bins is stationary relative to the axis.

31. The printing apparatus of claim 25 further comprising a finishing device to perform a finishing operation on the print media.

32. The printing apparatus of claim 31, wherein the finishing device is a stapler integrated within the accumulator.

* * * * *

UNITED STATES PATENT AND TRADEMARK OFFICE

CERTIFICATE OF CORRECTION

PATENT NO. : 7,311,303 B2
APPLICATION NO. : 10/626939
DATED : December 25, 2007
INVENTOR(S) : Roberto Gonzalez Gonzalez It is certified that error appears in the above-identified patent and that said Letters Patent is hereby corrected as shown below:

In column 2, line 46, delete “medial” and insert -- media --, therefor.

In column 8, line 9, in Claim 5, after “media to” insert -- the --.

Signed and Sealed this

Fifth Day of August, 2008

JON W. DUDAS
*Director of the United States Patent and Trademark Office*